US007333057B2

(12) United States Patent
Snyder

(10) Patent No.: US 7,333,057 B2
(45) Date of Patent: Feb. 19, 2008

(54) STACKED PATCH ANTENNA WITH DISTRIBUTED REACTIVE NETWORK PROXIMITY FEED

(75) Inventor: Christopher A. Snyder, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/903,930

(22) Filed: Jul. 31, 2004

(65) Prior Publication Data

US 2006/0022874 A1 Feb. 2, 2006

(51) Int. Cl.
*H01Q 1/38* (2006.01)

(52) U.S. Cl. ..... 343/700 MS; 343/745; 343/815; 343/822; 343/850

(58) Field of Classification Search ..... 343/860, 343/745

See application file for complete search history.

(56) References Cited

U.S. PATENT DOCUMENTS

| | | | | |
|---|---|---|---|---|
| 4,101,896 | A * | 7/1978 | Ikrath et al. | 343/713 |
| 4,386,357 | A | 5/1983 | Patton | 343/700 |
| 4,835,538 | A | 5/1989 | McKenna et al. | 343/700 |
| 4,853,703 | A | 8/1989 | Murakami et al. | 343/700 |
| 5,155,493 | A | 10/1992 | Thursby et al. | 343/700 |
| 5,243,353 | A * | 9/1993 | Nakahara et al. | 343/700 MS |
| 5,309,163 | A | 5/1994 | Ngan et al. | 343/700 |
| 5,386,214 | A | 1/1995 | Sugwara | 343/700 |
| 5,396,202 | A | 3/1995 | Scheck | 343/700 |
| 5,633,645 | A | 5/1997 | Day | 343/700 |
| 5,874,919 | A | 2/1999 | Rawnick et al. | 343/700 |
| 5,907,304 | A | 5/1999 | Wilson et al. | 343/700 |
| 5,931,456 | A | 8/1999 | Laidlaw et al. | 271/171 |
| 6,069,587 | A | 5/2000 | Lynch et al. | 343/700 |
| 6,079,973 | A | 6/2000 | Manera et al. | 425/556 |
| 6,118,406 | A | 9/2000 | Josypenko | 343/700 |
| 6,320,509 | B1 | 11/2001 | Brady et al. | 340/572.7 |
| 6,366,260 | B1 | 4/2002 | Currender | 343/866 |
| 6,377,216 | B1 | 4/2002 | Cheadle et al. | 343/700 |
| 6,462,710 | B1 | 10/2002 | Carson et al. | 343/700 |
| 6,501,437 | B1 | 12/2002 | Gyuorko et al. | 343/895 |
| 6,597,321 | B2 | 7/2003 | Thursby et al. | 343/744 |
| 6,608,594 | B1 | 8/2003 | Kane et al. | 343/700 |
| 6,639,555 | B1 | 10/2003 | Kane et al. | 343/700 |
| 6,717,549 | B2 * | 4/2004 | Rawnick et al. | 343/700 MS |
| 6,741,212 | B2 | 5/2004 | Kralovec et al. | 343/700 |
| 6,765,540 | B2 * | 7/2004 | Toncich | 343/860 |
| 6,873,299 | B2 * | 3/2005 | Dakeya et al. | 343/745 |
| 2002/0149535 | A1 * | 10/2002 | Toncich | 343/860 |

OTHER PUBLICATIONS

"Survey of Broadband Microstrip Pitch Antennas", *Microwave Journal*, Sep. 1996.
"Patent Review, C-L-C Feed for Stacked Patch", Harris Proprietary Information Jan. 2004.
"Increasing the Bandwidth of Microstrip Antenna by Proximity Coupling", *Electronic Letters*, vol. 23, No. 8, Apr. 9, 1987.

(Continued)

*Primary Examiner*—Trinh Vo Dinh
(74) *Attorney, Agent, or Firm*—Holland & Knight LLP

(57) ABSTRACT

A stacked patch antenna including a distributed reactive network proximity feed, preferably implemented in a microstrip metallization network, coupled to an active antenna patch element to feed the active antenna patch element to emit a field to parasitically stimulate a parasitic antenna patch element.

10 Claims, 5 Drawing Sheets

OTHER PUBLICATIONS

"Experimental Investigation of Three-Layer Electromagnetically Coupled Circular Microstrip Antennas", *Electronic Letters*, vol. 27, No. 13, Jun. 20, 1991, p. 1187-1189.

"An Impedance-Matching Technique for Increasing the Bandwidth of Microstrip Antennas", by Hugh F. Pues and Antoine R. Van De Capelle, *IEEE Transactions on Antennas and Propagation*, vol. 37, No. 11, Nov. 1989, pp. 1345-1354.

"Broadband Microstrip Antenna Design with the Simplified Real Frequency Technique", by Hongming An, Bart K.J.C. Nauwelaers and Antoine R. Van de Capelle, *IEEE Transactions on Antennas and Propagation*, vol. 42, No. 2, Feb. 1994, p. 129-136.

"A Class of Enhanced Electromagnetically Coupled Feed geometrics for Printed Antenna Applications" by Das et al; 1990 IEEE; pp. 1100-1103.

"Stacked Microstrip Antenna With Wide Band and High Gain" by Egashira et al.; 1990 IEEE, pp. 1132-1135.

"Displaced Multilayer Triangular Elements Widen Antenna Bandwidth" vol. 24, No. 15, Jul. 21, 1988, *Electronics Letters*, pp. 962-964.

* cited by examiner

STACKED PATCH ANTENNA WITH DISTRIBUTED REACTIVE NETWORK PROXIMITY FEED

BACKGROUND OF THE INVENTION

1. Field of the Invention

This invention relates to stacked patch antennas. More particularly, this invention relates to stacked patch antennas having increased bandwidth.

2. Description of the Background Art

Presently there exist many types of stacked patch antennas. Conventional stacked patch antennas are pin fed and achieve only narrow bandwidths on the order of seven to ten percent. More advanced stacked patch antennas such as those described in U.S. Pat. No. 5,874,919, the disclosure of which is hereby incorporated by reference herein, are stub tuned and proximity fed to increase their bandwidth over the conventional stacked patch antennas. A typical use for stacked patch antennas is described in U.S. Pat. No. 5,907,304, the disclosure of which is hereby incorporated by reference herein While stub tuned, proximity fed stacked patch antennas have achieved widespread success, there nevertheless presently exists a need for further improved stacked patch antennas having further increase bandwidths that may be economically produced.

Therefore, it is an object of this invention to provide an improvement which overcomes the aforementioned inadequacies of the prior art devices and provides an improvement which is a significant contribution to the advancement of the stacked patch antenna art.

Another object of this invention is to provide a stacked patch antenna having increased bandwidth over convention or other stacked patch antenna designs.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, the invention comprises a stacked patch antenna and a distributed reactive network proximity feed coupled to the stacked patch antenna. Preferably the stacked patch antenna comprises an active antenna patch element and a parasitic antenna patch element separated by an insulting spacer layer such that the active antenna patch element emits a field to parasitically stimulate said parasitic antenna patch element.

Also preferably, the distributed reactive network proximity feed comprises appropriate inductive and capacitive reactive elements formed by microstrip metallization whose inductance and/or capacitance are selected to optimally match the input impedance of the stacked patch antenna and thereby tune the circuit to resonate across a wider bandwidth.

In the most preferred embodiment, the distributed reactive network proximity feed comprises a Pi network composed of an inductor between a ground-coupled source capacitor and a ground-coupled output capacitor whose values are selected to tune the circuit to resonance. However, many equivalent forms of reactive circuits may be employed as transformations thereof to match the input impedance of the stacked patch antenna and thereby tune the circuit to resonance.

The invention significantly overcomes the limitations of prior art stacked patch antennas relating to coupling efficiencies, frequency responses and manufacturing constraints. Indeed, the invention reduces the Q factor of match-improving bandwidth and increased manufacturability. Moreover, the invention allows tuning of the reactive elements to achieve significant impedance control while maximizing bandwidth/VSWR trades.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other circuits and assemblies for carrying out the same purposes of the present invention. It should also be realized by those skilled in the art that such equivalent circuits and assemblies do not depart from the spirit and scope of the invention as set forth in the appended claims.

BRIEF DESCRIPTION OF THE DRAWINGS

For a fuller understanding of the nature and objects of the invention, reference should be had to the following detailed description of the preferred embodiment taken in connection with the accompanying drawings in which.

Similar reference characters refer to similar parts throughout the several views of the drawings.

DETAILED DESCRIPTION OF THE PREFERRED EMBODIMENT

Figure 1:
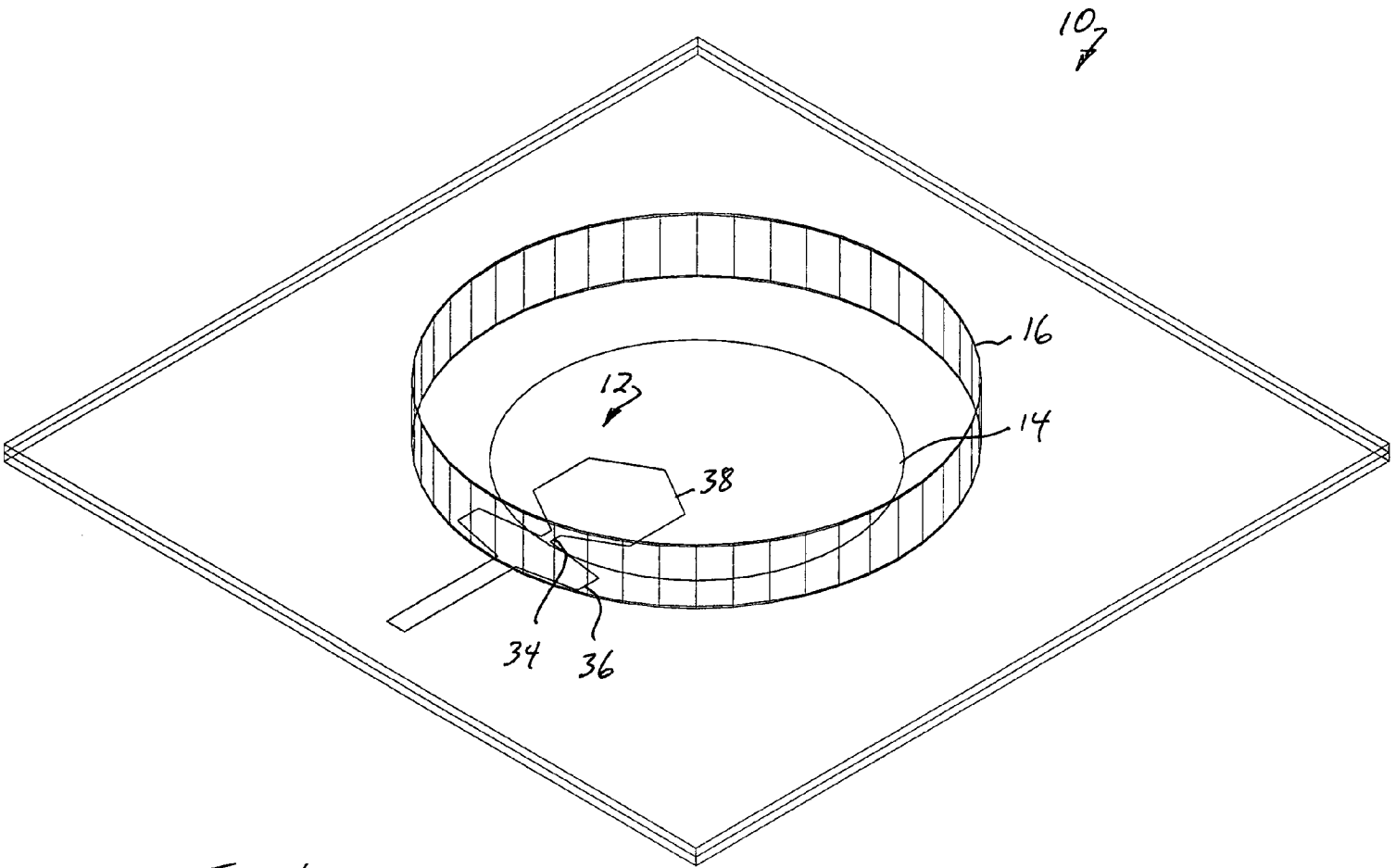
FIG. 1 is a schematic perspective view of the preferred embodiment of the stacked patch antenna of the invention having a distributed reactive network proximity feed.

Referring to FIG. 1, the preferred embodiment of the stacked patch antenna of the invention includes a distributed reactive network proximity feed generally indicated by the numerals 10 and 12, respectively.

Figure 2:
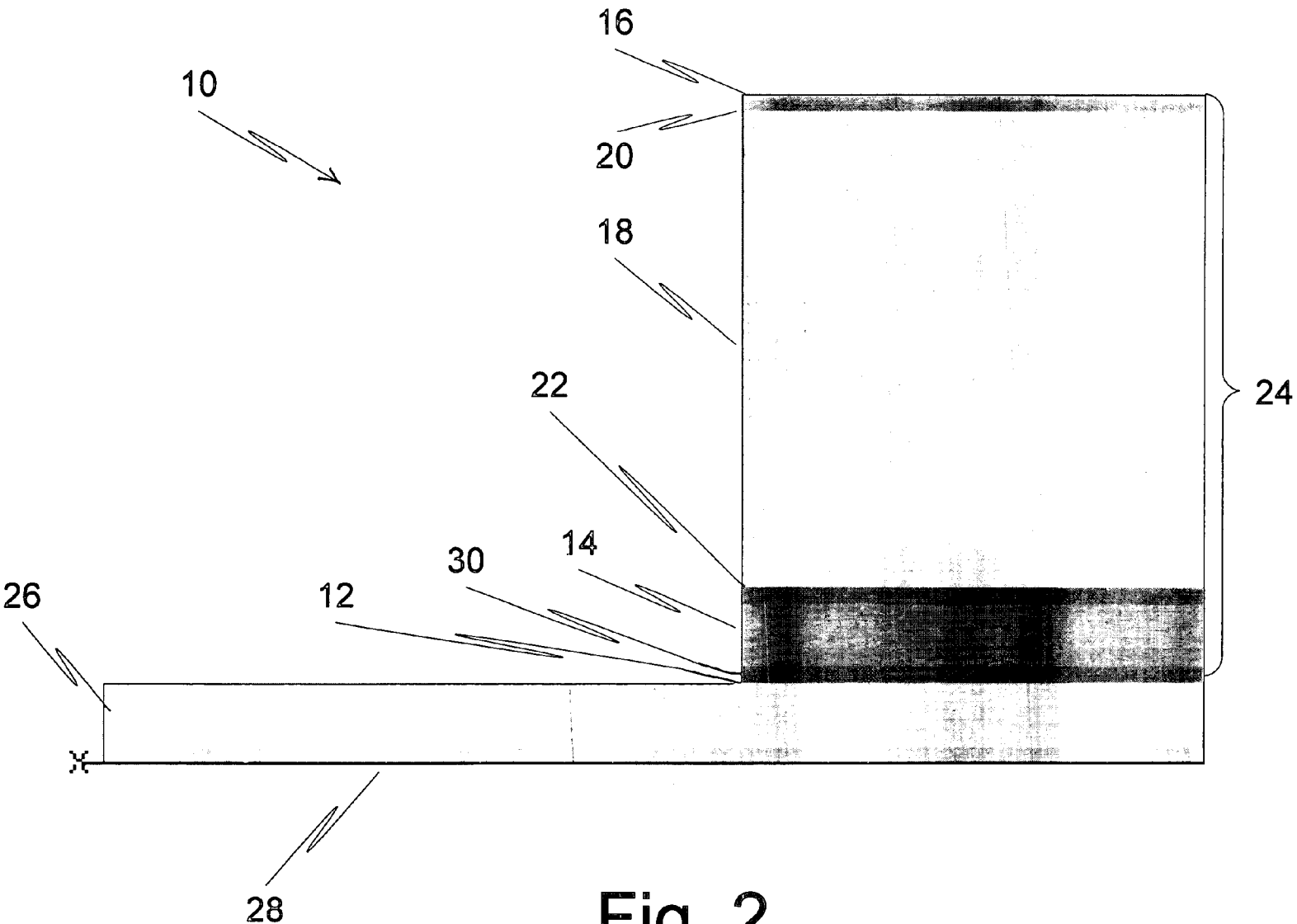
FIG. 2 is a side elevational view of FIG. 1 showing the assembly of the preferred embodiment of the stacked patch antenna of the invention having a distributed reactive network proximity feed.

As best shown in FIG. 2, the stacked patch antenna 10 of the invention preferably comprises an antenna of the general type disclosed in the commonly-owned U.S. Pat. No. 5,874,919, the disclosure of which is incorporated by reference herein.

Specifically, stacked patch antenna 10 preferably comprises an active antenna patch element 14 comprising a conductive layer. The active antenna patch element 14 more preferably comprises a disc-shaped layer of metallization such as copper having a radius that defines a first resonant frequency falling within the design bandwidth of the antenna. As used herein, reference to an active antenna patch element 14 means that when an antenna microstrip feed layer 16, such as a layer of fifty ohm transmission line, is field coupled to the active antenna patch element 14 via the distributed reactive network proximity feed 12, it operates in a radiating mode and serves as the primary or active emission element of the antenna.

The stacked patch antenna 10 of the invention further comprises a parasitic (i.e., "passive") antenna patch element 16. The parasitic antenna patch element 16 preferably comprises a disc-shaped layer of metallization such as a copper foil having a radius that defines a second resonant frequency that falls within the bandwidth of the antenna.

Parasitic antenna patch element 16 is preferably aligned to be concentric with and vertically spaced apart from the active antenna patch element 14. The parasitic antenna patch element 16 preferably operates in a radiation mode by being parasitically stimulated by the field emitted by the active antenna patch element 14. Hence, unlike the active antenna patch element 14, the parasitic antenna patch element 16 need not be, and is preferably not, directly coupled to a feed.

More preferably, the parasitic antenna patch element 16 has a radius larger than that of the active antenna patch element 14 such that the parasitic antenna patch element 16 has a resonant frequency that is slightly lower than that of the active antenna patch element 14.

Preferably the vertical spacing between the active antenna patch element 14 and the parasitic antenna patch element 16 is achieved by a disk-shaped insulating spacer layer 18 positioned therebetween. Adhesive layers 20 and 22 attach the active antenna patch element 14 and the parasitic antenna patch element 16 to the top and bottom of the insulating spacer layer 18, respectively.

Preferably, the insulating spacer layer 18 comprises a dielectric foam layer and, more preferably, may comprise the dielectric foam identified as Röhm Rohacell 51 HF Foam having a thickness of approximately 60 mils, an Er of 1.067 and a Tan δ of 0.004. Also preferably, while many types of adhesive materials may suffice, the adhesive layers 20 and 22 preferably comprise a space-qualifiable material such as the "peel and stick". 3M Adhesive Transfer Tape 966 having a thickness of two mils, and Er of 2.5 and a Tan δ of 0.025.

The stacked assembly of the parasitic antenna patch element 16 and the active antenna patch element 14 are preferably manufactured from commercially available microwave laminates and assembled or "stacked" with the insulating spacer layer 24 therebetween in the form of a what is commonly referred to by those skilled in the art as a "puck" 24. In this regard, the active antenna patch element 14 is preferably manufactured from a microwave laminate known to those skilled in the art as Rogers 4003C having a thickness of about 8 mils, an Er of 3.38 and a Tan δ of 0.003. The layers of the Rogers 4003C laminate are more particularly identified as:

| Quantity | Material | Type | Thickness (mm) |
|---|---|---|---|
| 1 | copper plating | 25 μm | 0.025 |
| 1 | copper foil | 12 μm | 0.012 |
| 1 | Prepreg | 2116 | 0.115 |
| 1 | inner layers | 0.508 mm 35/35 | 0.558* |
| 1 | prepreg | 2116 | 0.115 |
| 1 | copper foil | 12 μm | 0.012 |
| 1 | copper plating | 25 μm | 0.025 |
| | | Total thickness: | 0.862 |

Specifically, as is known by one skilled in the art, the pucks 24 may be manufactured in quantities. Specifically, the patch elements 14 and 16 may each may be formed in sheets of microwave laminates using known photomask and etching procedures and after assembly with the insulating spacer layer therebetween using the adhesive layers 20 and 22, the "sandwich" is then cut into individual pucks. It is noted that appropriate registration marks are employed so that the laminates may be properly aligned with each other with the insulating spacer layer 18 therebetween to assure that when the puck 24 is cut the parasitic antenna patch elements 16 of the top laminate will be concentrically aligned with the respective active antenna patch elements 14 of the bottom laminate.

The puck 24 composed of the active antenna patch element 14, the insulating spacer layer 24 and the parasitic antenna patch element 16 is preferably disposed on top a dielectric substrate 26 in alignment with the distributed reactive network proximity feed 12 photomasked and etched on the dielectric substrate 26 (more particularly described hereinafter).

Similar to the active antenna patch element 14, the dielectric substrate 26 is preferably manufactured from a microwave laminate known to those skilled in the art the Rogers 4003C having a thickness of 8 mils, an Er of 3.38 and a Tan δ of 0.003, described above in greater detail.

The dielectric substrate 26 overlies a ground plane layer 28. The ground plane layer 28 may comprise the front facesheet of a panel-configured antenna module (not shown) such as that described in the commonly-owned U.S. Pat. No. 5,907,304, the disclosure of which is incorporated by reference herein. However, without departing from the spirit and scope of the invention, the ground plane layer 28 may comprise at least a portion of the ground plane of many other antenna modules.

The puck 24 is preferably attached to the dielectric substrate 26 by an adhesive layer 30. The material constituting the adhesive layer 30 is preferably selected to accommodate the underlying distributed reactive network proximity feed 12. More preferably, the adhesive is preferably selected such that the active antenna patch element 14 is effectively plane-conformal with the dielectric substrate 18 and may comprise the adhesive material identified above forming the other adhesive layers 20 and 22.

The distributed reactive network proximity feed 12 generally comprises a reactive circuit formed by microstrip metallization whose inductance and/or capacitance are selected to optimally match the input impedance of the stacked patch antenna 10 and thereby tune the circuit to resonance across a wide bandwidth. It should be appreciated to one skilled in the art that many equivalent forms of reactive circuits may suffice, some of which may be easily transformed from others, and still match the input impedance of the stacked patch antenna 10.

Figure 3:
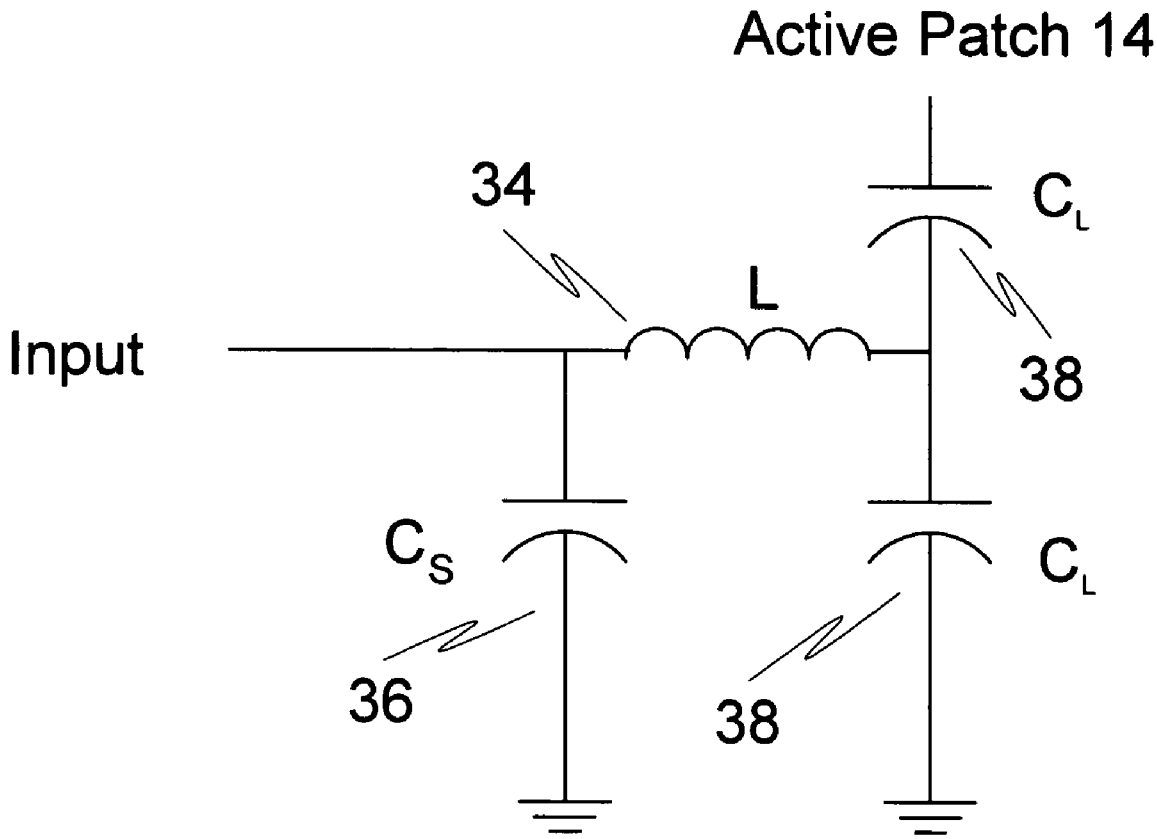
FIG. 3 is a schematic diagram of the of the stacked patch antenna of the invention having a distributed reactive network proximity feed in the form of a Pi network proximity feed.

In the preferred embodiment of the invention, the distributed reactive network proximity feed 12 comprises a Pi (π) network 32. As shown in the schematic of FIG. 3, the Pi network proximity feed 32 of the invention comprises an inductor 34 electrically connected between a ground-coupled source capacitor 36 and a ground-coupled load capacitor 38 electrically connected serially between the antenna input feed and the active antenna patch element 14 of the puck 24, thereby defining a conventional "π" or "Pi" configuration of an impedance-matching network.

The design considerations and functionality of a Pi impedance-matching network are well-known in the art. A generalized formula for a Pi network is as follows:

$$R_S \rangle R_{L_1} \quad Q \rangle \sqrt{R_S / R_L - 1}$$

$$X_{C_S} = \frac{R_S}{Q}$$

$$X_{C_L} = R_L \sqrt{\frac{R_S / R_L}{Q^2 + 1 - (R_S / R_L)}}$$

$$X_L = \frac{QR_S + (R_S R_L / X_{C_L})}{Q^2 + 1}$$

Representative source material describing such design consideration and functionality of Pi impedance-matching networks may be found in the following web sites, the disclosures of which are hereby incorporated by reference herein:

http://beradio.com/departments/radio_impedance_matching/ http://xanadu.ece.ucsb.edu/~long/ece145a/Notes5_Matching_networks_F02.pdf http://home.earthlink.net/~jimlux/radio/math/wyedelta.htm http://www.gsl.net/aa3sj/Pages/50 MHz—Tuner.html http://my.integritynet.com.au/purdic/lowpass.html http://home.earthlink.net/~jimlux/radio/antenna/phased/networks.htm The wide-spread use of Pi impedance-matching networks has resulted in on-line "calculators" that automatically compute the inductance and capacitance values based upon the source and load impedances. Representative online Pi impedance-matching "calculators" may be found in the following web sites, the disclosures of which are hereby incorporated by reference herein:

http://my.athenet.net/~multiplx/cgi-bin/pinet.main.cgi http://www.qs1.net/wa2whv/radiocalcs.shtml http://www.raltron.com/cust/tools/network$_{13}$ empedance_matching.asp As appreciated by one skilled in the art, the desired values of the inductor 34 and the capacitors 36 and 38 of the preferred Pi network proximity feed 32, or more generally the reactive elements of other distributed reactive network proximity feed 12 of the invention, are easily computed based upon the load impedance of the stacked patch antenna 10.

It should also be appreciated by those skilled in the art that the computed desired values of such reactive elements are formed by conductive patterns and are dependent on their respective physical layouts and dimensions. Specifically, the inductance of inductors are largely a function of their relative narrow width and thickness of their patterns whereas the capacitances of the capacitors are a function of the sizes of their overlapping respective physical areas than the specific shape of their physical patterns. By way of example, the inductance of metalized layers may be computed as follows:

$$L_{trace-ground} \approx \frac{\mu_0 \mu_r h}{w} \quad (w >> h,\ h > t)$$

where w is the width of the trace, h is the height of the trace above ground, t is the thickness of the trace and μr is the relative permeability of the medium.

Figure 4:
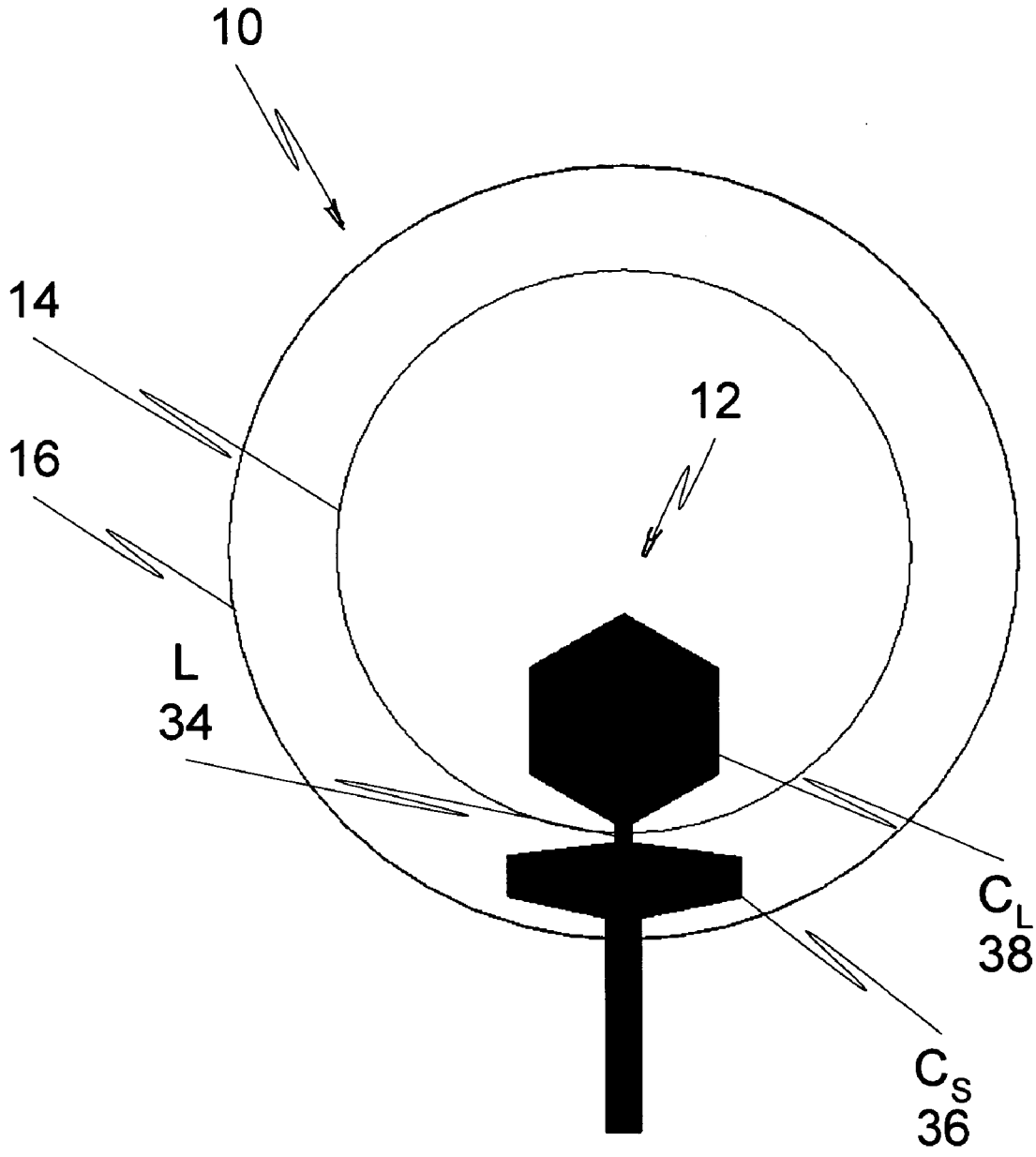
FIG. 4 is a top plan view of FIG. 1 showing the preferred configuration of the stacked patch antenna of the invention having a distributed reactive network proximity feed in the form of a Pi network proximity feed implemented with distributed capacitors and an inductor.

Representative inductance and capacitance calculators may be found at the following websites, the disclosures of which are hereby incorporated by reference herein:

http://emcsun.ece.umr.edu/new-induct/g-trace.html http://www.csgnetwork.com/parapltcapcalc.html As shown in FIG. 4, the implemented embodiment of the Pi network proximity feed 32 of the preferred embodiment of the invention includes the source capacitor 36 having an generally elliptical shape, the inductor 34 having a narrow trace shape and a load capacitor 38 having a hexagon shape. However, it should be appreciated by those skilled in the art that the spirit and scope of this invention is not limited to such specific shapes and that many other shapes may suffice as may be appropriate to achieve the desired inductance and capacitance of the inductor 34 and the capacitors 36 and 38 of the Pi network 32 or as may be needed to implement other transformations of the distributed reactive network proximity feed of the invention.

With it likewise being appreciated by those skilled in the art that the spirit and scope of the invention is not limited to the specific implementation of the preferred embodiment, the best mode for implementing the preferred embodiment of the stacked patch antenna 10 of the invention included the following:

1. A square lattice of 0.9227"×0.9227" was employed for infinite array modeling. Polarization was linear.
2. The Rogers 4003 cladding was ½ oz.
3. The 50 Ohm line width used was 24 mils.
4. The network proximity feed 12 was 10 mils off of the ground plane due to combined adhesive and laminate thickness.
5. The active patch element 14 was 20 mils off of the face sheet and 390 mils in diameter.
6. The foam thickness of the insulating spacer layer 18 was 60 mils
7. The parasitic patch element 16 was 84 mils from ground, 64 mils from the active patch element 14 and 536 mils in diameter.
8. The area of the source capacitor 36 was 0.0066 in$^2$ for ~0.5 pF.
9. The length of the inductor 34 was 0.014" with a width of 0.012" for ~0.5 nH.
10. The area of the load capacitor was 0.0142 in$^2$ for ~1.0 pF.

Figure 5:
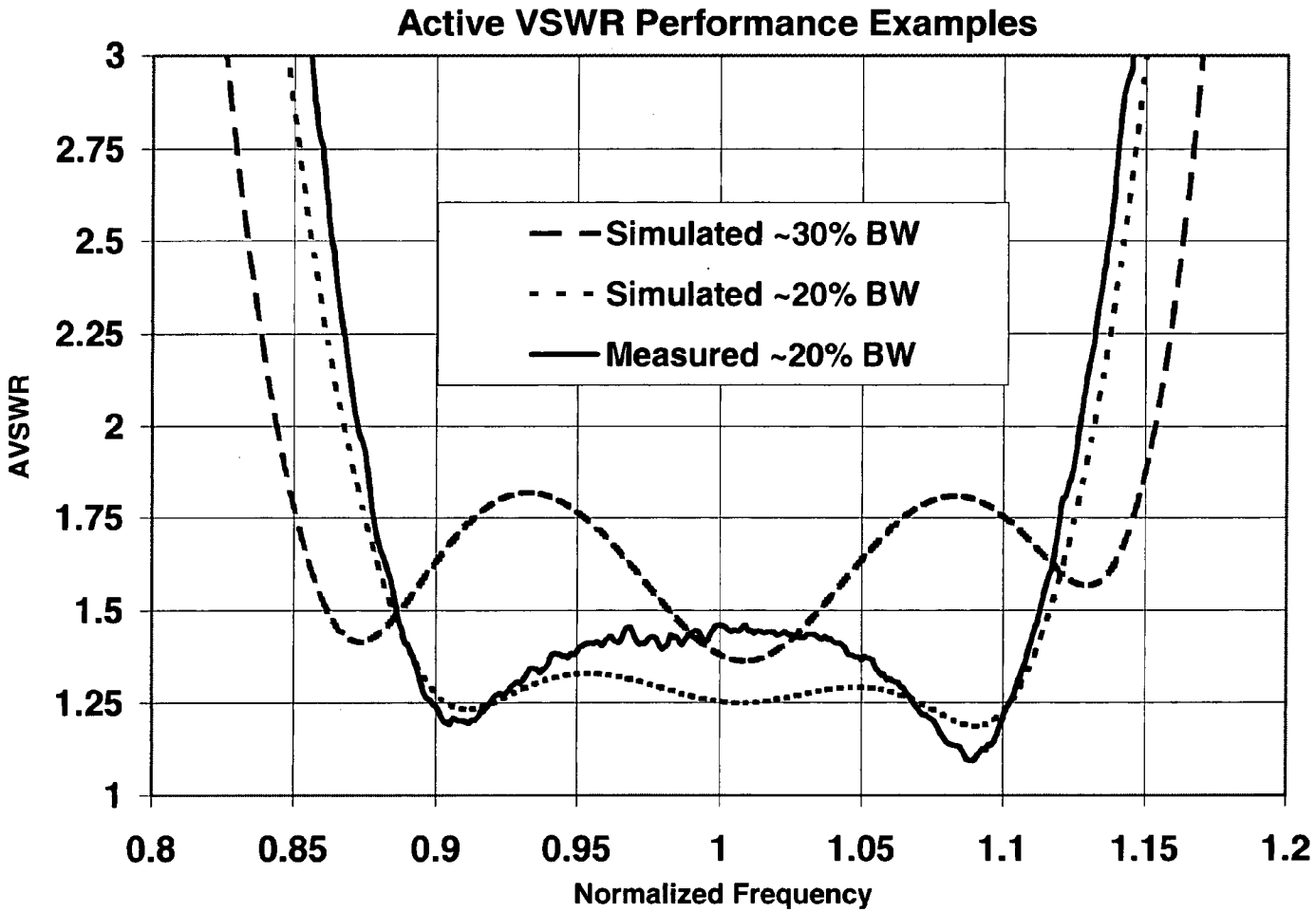
FIG. 5 is a chart plotting the active VSWR across normalized frequencies and including a series of simulated values for approximately 30% bandwidth, a series of simulated values for approximately 20% bandwidth and the measured values for approximately 20% bandwidth.

The chart of FIG. 5 comprises a plot of the active VSWR across normalized frequencies and for comparison purposes illustrates a series of simulated values for approximately 30% bandwidth, a series of simulated values for approximately 20% bandwidth and for the implemented embodiment described above, the measured values for approximately 20% bandwidth. As can be appreciated, a significant increase in bandwidth is achieved by employing the Pi network proximity feed 12 of the invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A stacked patch antenna, comprising in combination:

an active antenna patch element;

a parasitic antenna patch element;

a microstrip metallization distributed reactive network proximity feed; and a substrate; said microstrip metallization distributed reactive network proximity feed having a configuration that is positioned between said active antenna patch element and said substrate entirely within the periphery of said parasitic antenna patch element to feed said active antenna patch element to emit a field to parasitically stimulate said parasitic antenna patch element, said distributed reactive network proximity feed comprising inductive and capacitive reactive elements whose inductance and capacitance are selected to optimally match the input impedance of the stacked patch antenna and thereby tune the circuit to resonate across a wide bandwidth, wherein a load capacitor of said distributed reactive network positioned entirely between the periphery of said active antenna patch element.

2. The stacked patch antenna as set forth in claim 1, wherein said distributed reactive network proximity feed comprises a Pi network having an inductor electrically connected between a source capacitor and said load capacitor.

3. The stacked patch antenna as set forth in claim 2, further including a ground plane and wherein said source capacitor and said load capacitor are ground-coupled to said ground plane.

4. The stacked patch antenna as set forth in claim 3, wherein the capacitance of each of said source capacitor and said load capacitor is predetermined based up their physical areas.

5. The stacked patch antenna as set forth in claim 3, wherein the inductance of said inductor is predetermined based up its narrowness.

6. The stacked patch antenna as set forth in claim 5, wherein said parasitic antenna patch element is parasitically stimulated by a field emitted by said active antenna patch element by positioning said parasitic antenna patch element proximate to said active antenna patch element.

7. The stacked patch antenna as set forth in claim 6, wherein said parasitic antenna patch element is positioned proximate to said active antenna patch element by a spacer positioned therebetween.

8. The stacked patch antenna as set forth in claim 7, wherein said parasitic antenna patch element and said active antenna patch element are attached to said spacer layer by adhesive layers.

9. A method for tuning a stacked patch antenna including an active antenna patch element coupled to a parasitic antenna patch element to feed said active antenna patch element to emit a field to parasitically stimulate said parasitic antenna patch element, comprising the step of positioning microstrip metallization distributed reactive network proximity feed having a configuration to be located between the active antenna patch element and a substrate entirely within the periphery of the active antenna patch element to tune the stacked patch antenna to resonance, said distributed reactive network proximity feed comprising inductive and capacitive reactive elements whose inductance and capacitance are selected to optimally match the input impedance of the stacked patch antenna and thereby tune the circuit to resonate across a wide bandwidth, wherein a load capacitor of said distributed reactive network positioned entirely between the periphery of said active antenna patch element.

10. The method as set forth in claim 9, wherein the step of coupling said distributed reactive network proximity feed to tune the stacked patch antenna to resonance comprises selecting reactive elements to tune the antenna to resonate across a wide bandwidth.

* * * * *